United States Patent [19]

Graf et al.

[11] 4,103,131

[45] Jul. 25, 1978

[54] PUFFER INTERRUPTER WITH MAIN AND AUXILIARY PISTONS AND COMMON CYLINDER

[75] Inventors: Rudolf Graf, Oberentfelden; Ernst Lang, Schlossrued; Viktor Stephanides, Zurich; Richard Thaler, Unterentfelden; Hans-Rudolf Wüethrich, Oberentfelden, all of Switzerland

[73] Assignee: Sprecher & Schuh Ltd. (SSA), Aarau, Switzerland

[21] Appl. No.: 724,617

[22] Filed: Sep. 20, 1976

[30] Foreign Application Priority Data

Sep. 26, 1975 [CH] Switzerland ..... 12542/75

[51] Int. Cl.[2] ..... H01H 33/88

[52] U.S. Cl. ..... 200/148 A; 200/148 F

[58] Field of Search ..... 200/148 A, 148 R, 148 F

[56] References Cited

U.S. PATENT DOCUMENTS

| | | | |
|---|---|---|---|
| 2,913,559 | 11/1959 | Cromer | 200/148 A |
| 3,955,057 | 5/1976 | Dabringhausen | 200/148 A |

FOREIGN PATENT DOCUMENTS

| | | | |
|---|---|---|---|
| 1,216,407 | 5/1966 | Fed. Rep. of Germany | 200/148 A |

*Primary Examiner*—Robert S. Macon

*Attorney, Agent, or Firm*—Ostrolenk, Faber, Gerb & Soffen

[57] ABSTRACT

A puffer-type interrupter for a circuit breaker has a stationary piston received in a movable cylinder which is connected to the movable contact of the interrupter, and which also carries a nozzle for producing a blast of gas through the separating contacts of the interrupter when the cylinder is moved over the piston. An auxiliary piston is slidably mounted relative to the main piston, and mechanism is provided to connect the two pistons together when the interrupter contacts are closed, and to connect the auxiliary piston to the movable cylinder after the contacts have separated. The main pressure chamber within the cylinder and the fixed piston is connected to an auxiliary pressure chamber disposed between the main piston and the auxiliary piston in such a manner that, as the separating contacts reach an optimum separation for contact interruption, the pressure within the main cylinder can drop to a preselected value by pressure flow into the intermediate chamber between the main piston and auxiliary piston, thereby to control the force characteristic required for the operation of the interrupter.

7 Claims, 2 Drawing Figures

PUFFER INTERRUPTER WITH MAIN AND AUXILIARY PISTONS AND COMMON CYLINDER

RELATED APPLICATIONS

This application is related to copending application Ser. No. 712,642, filed Aug. 9, 1976, entitled PUFFER INTERRUPTER WITH CYLINDER PRESSURE-RELIEF VALVE and copending application Ser. No. 702,425, filed July 6, 1976, entitled PUFFER INTERRUPTER WITH PISTON BYPASS CHANNEL.

BACKGROUND OF THE INVENTION

This invention relates to circuit interrupters, and more specifically relates to a novel puffer-type circuit interrupter in which a blast of electronegative gas is forced through separating contacts by a nozzle surrounding the interrupter contacts. Gas is forced through the nozzle by virtue of a piston and cylinder arrangement which defines a volume in connection with the nozzle, which volume is reduced when the interrupter is operated to open the interrupter contacts.

Puffer-type interrupters of the type to which the invention relates are shown in the above-referenced applications Ser. No. 712,642 and Ser. No. 702,425 and are also shown in German Published Application 2,363,171. In the above German publication, the main piston of the interrupter is flexibly supported on an auxiliary piston and the cylinder carries a nozzle which is arranged to direct pressurized gas from the interior of the cylinder through the separating contacts of the interrupter. In an arrangement of this type, it is possible to reduce the operating force for operating the cylinder and interrupter contacts during contact interruption as compared to the forces required if the unit had only a single piston. However, in the above arrangement, the operating mechanism must be capable of supplying enough force to overcome the spring force of the flexible coupling between the main and auxiliary pistons.

The spring force which must be overcome in the above arrangement is at its greatest at the time that the contacts are approaching the end of their opening movement and precisely at the point where the greatest flow of fluid through the interrupting contacts is desired. However, since the spring force is substantially high at this point, the spring opposes the continued movement of the cylinder by the operating mechanism so that the fluid flow from the cylinder is reduced.

BRIEF DESCRIPTION OF THE PRESENT INVENTION

In accordance with the present invention, a novel arrangement of main and auxiliary pistons is provided wherein the interspace between them is controlled by one-way valves in the piston, and whereby means are provided for connecting the pistons together at the beginning of the opening stroke of the cylinder and for connecting the auxiliary piston to the cylinder toward the end of the cylinder stroke to insure at least a constant pressure within the main cylinder for producing fluid flow through the orifice toward the end of the cylinder stroke and without exerting an undue opposition force on the operation mechanism.

DETAILED DESCRIPTION OF THE DRAWINGS

Figure 1:
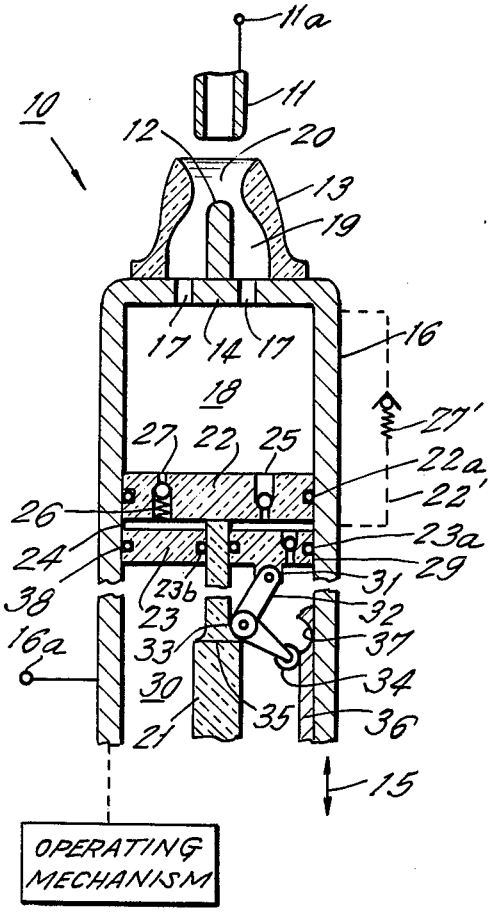
FIG. 1 schematically illustrates a portion of a puffer interrupter in longitudinal section which incorporates the novel construction of the present invention.

Referring first to FIG. 1, the interrupter is schematically illustrated by numeral 10 and will be contained within a sealed housing (not shown). The interrupter contains a tubular fixed contact 11 which cooperates with a movable pin-type interrupter contact 12. The movable contact 12 is surrounded by an insulation nozzle 13 which is fixed on the end wall 14 of conductive cylinder 16. The conductive cylinder 16 is movable in the direction of the double arrow 15 under the influence of a suitable operating mechanism which is schematically illustrated in FIG. 1 and may be of any desired type.

The interrupter terminals are also schematically illustrated in FIG. 1 as consisting of terminal **11*a* connected to fixed contact 11 and contact 16*a* which is slidably connected to the conductive cylinder 16. Note that terminals 11*a* and 16*a* will be accessible externally of the housing which encloses the interrupter of FIG. 1**.

FIG. 1 further illustrates gas passages 17 in the end wall 14 which connects the main cylinder volume 18 within cylinder 16 to the channel 19 within nozzle 13. Note that the narrowest opening of the nozzle 13 is located adjacent to but slightly downstream of the end of movable contact 12.

The cylinder 16 is then arranged to move over a fixed main piston 22 which is supported on a stationary insulation piston rod 21. The upper smaller diameter region of piston rod 21 slidably receives an auxiliary piston 23 which is movable relative to the fixed piston 22. Note that the fixed piston 22 is provided with a peripheral annular seal ring **11*a* for forming a seal to the interior of cylinder 16 and a similar sliding seal 23*a* is provided for the auxiliary piston 23. In addition, an internal ring 23*b* extends between piston rod 21 and auxiliary piston 23**.

An auxiliary volume 24 is then defined between the relatively movable main piston 22 and auxiliary piston 23, which volume will depend on the relative positions of the two pistons. Volumes 18 and 24 are interconnected by two valves in the main piston 22. The first of these valves is an unloaded check valve 25 which may be of any conventional ball type or other type, which valve 25 remains closed so long as the pressure in volume 18 is greater than the pressure in volume 24. The second valve in piston 22 is a pressure-limiting valve 27 loaded by a calibrating spring 26, which valve maintains a constant pressure gradient between the volumes 18 and 24.

FIG. 1 also illustrates in dotted lines that the valve 27 could be installed in a conduit extending between volume 18 and volume 24, schematically illustrated as conduit 22', which contains a pressure-limiting valve 27'. The auxiliary piston 23 is also provided with an unloaded check valve 29 which opens toward volume 24 and remains closed so long as the pressure within volume 24 is higher than that in the external volume 30 below the auxiliary piston 23.

In order to selectively connect auxiliary piston 23 to either the main piston 22 or the cylinder 16, the auxiliary piston 23 is provided with the pivotal connection member 31, which pivotally receives one end of the crank arm 32. The vertex of the crank arm 32 has a roller 33 rotatably mounted thereon, and also has a roller 34 rotatably mounted thereon. Roller 33 then rolls over the circular section of insulation rod 21 and can be latched by the shoulder 35 of the insulation rod 21, as shown in FIG. 1. At the same time, the roller 34 runs over a slide block 36 which is fixed within the inside of the cylinder 16.

The upper end of slide block 36 has a circular depression 37 therein which can receive the roller 34 when the slide block 36 aligns depression 37 with the roller 34. When the interrupter of FIG. 1 is closed, the cylinder 16 is moved upwardly and the contact 12 engages contact 11 and the contact 11 is tightly surrounded by region 20 of the nozzle 13. The slide block 36 at this time presses against roller 34 and thus presses the roller 33 into the shoulder 35 of the insulation rod 21. The auxiliary piston 23 is, therefore, coupled to the main piston 22.

In order to move the interrupter to an open position, the operating mechanism moves the cylinder 16 downwardly and the volume 18 is compressed and forces gas such as sulfur hexafluoride through the nozzle 13 and between the separating contacts 11 and 12. The pressure within volume 18 and thus the driving force required to move cylinder 16 increases constantly as the cylinder 16 moves downwardly so long as pistons 22 and 23 are coupled together. However, once the cylinder 16 has moved down sufficiently for the roller 34 to enter depression 37, the roller 33 will roll over the shoulder 35. Note that there is a constant downward force on the auxiliary piston 23 due to the frictional engagement between the piston 23 and the cylinder 16 at the gasket 23*a*. This frictional force is overcome when the roller 33 is latched into shoulder 35 as shown in FIG. 1 but, when the roller 34 enters depression 37, the auxiliary piston 23 can move downwardly, with the roller 33 rolling over shoulder 35. The auxiliary piston 23 is then latched to the cylinder 16 and moves downwardly with the cylinder 16.

The main cylinder volume 18 continues to reduce so that gas continues to be expelled from the volume 18 through the nozzle 13. However, the volume 24 is increasing and the pressure gradient between the decreasing volume 18 and the increasing volume 24 remains constant due to the pressure-limiting valve 27.

If, at the beginning of this phase, the pressure in intermediate chamber or volume 24 falls below that of volume 30, the check valve 29 in piston 23 will open to admit more gas into volume 24. Thus, with the system operating in this manner, the force required for the operating mechanism to continue to move cylinder 16 downwardly will not increase toward the end of the cylinder stroke. Preferably, the response pressure of the pressure-limiting valve 27 and the length of the stroke of cylinder 16 until pistons 22 and 23 are uncoupled from each other are advantageously matched so that the pressure in proportion to the external volume 30 in volume 18 at the end of this stroke will correspond approximately to the sum of the response pressure of pressure-limiting valve 27 and of the pressure in volume 24. The operating mechanism has to work only with the response pressure of pressure-limiting valve 27.

In order to reclose the interrupter, the cylinder 16 is moved upwardly by the operating mechanism, with the auxiliary piston 23 locked thereto and the above operations are repeated in a reverse order, with the check valves 25 and 29 opening to draw fresh gas into volumes 18 and 24 from the volume 30.

Figure 2:
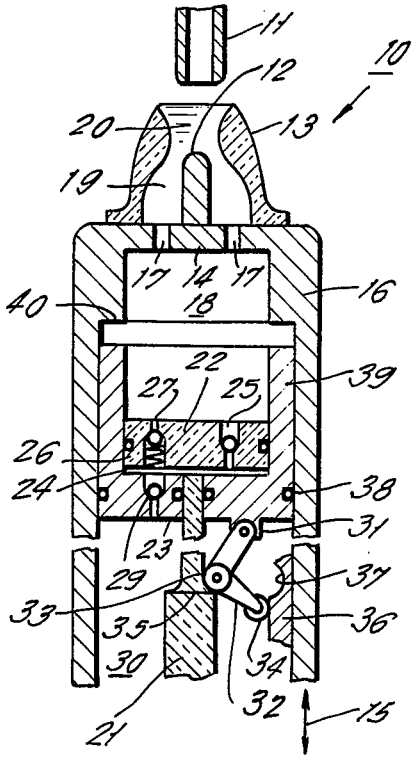
FIG. 2 is a view similar to that of FIG. 1 and illustrates a second embodiment of the present invention.

FIG. 2 shows a second embodiment of the invention wherein components identical to those of FIG. 1 have been given similar identifying numerals. FIG. 2 differs from FIG. 1 in the construction and arrangement of the main piston 22 and auxiliary piston 23. Thus, the auxiliary piston 23 in FIG. 1 consists of a cup-shaped member 39 which is movable within the cylinder 16, with the cup-shaped member 39 receiving the main stationary piston 22.

The cylinder 16 is also formed with an internal shoulder 40 which faces pistons 22 and 23, where the larger internal diameter of cylinder 16 receives the outer diameter of auxiliary piston 39, while the smaller diameter of cylinder 16 corresponds to the outer diameter of the main piston 22.

In FIG. 2, the depression 37 in the slide plate 36 is selected such that the auxiliary piston 23 is locked to cylinder 16 when the top of cup-shaped member 39 reaches shoulder 40. In the embodiment of FIG. 2, it is possible to supply a constant operating force to the cylinder 16 while obtaining an increased pressure within volume 18 in the latter part of the opening motion of cylinder 16.

Although a preferred embodiment of this invention has been described, many variations and modifications will now be apparent to those skilled in the art, and it is preferred, therefore, that the instant invention be limited not by the specific disclosure herein but only by the appended claims.

The embodiments of the invention in which an exclusive privilege or property is claimed are defined as follows:

1. A puffer-type circuit interrupter comprising, in combination:

a main stationary piston member supported on an elongated stationary support rod, an auxiliary piston mounted concentrically with said main piston and slidably mounted on said support rod, an axially movable cylinder slidably receiving both said main and auxiliary pistons and relatively movable with respect thereto, a main pressure volume disposed between said main piston and one end of said cylinder, an auxiliary pressure volume disposed between said main and auxiliary pistons, contact means and nozzle means disposed at said one end of said cylinder and channel means communicating between said main pressure volume and said nozzle means and said contact means to produce a gas blast past said contact means when said cylinder moves to compress said main volume, pressure-limiting valve means connected between said main and auxiliary pressure volumes to maintain no greater than a given pressure differential between said volumes, and connection means for connecting said auxiliary piston to said main piston when said cylinder is initially moved to compress said main volume, and thereafter disconnecting said main and auxiliary volumes, and connecting said auxiliary piston to said cylinder.

2. The interrupter of claim 1 wherein said auxiliary and main pistons have one-way valves therein to permit gas flow into said main and auxiliary volumes.

3. The interrupter of claim 1 wherein said connection means includes a slide member connected to said cylinder and a roller bearing crank member carried by said auxiliary piston and selectively latchable to said stationary support rod or said cylinder.

4. The interrupter of claim 2 wherein said connection means includes a slide member connected to said cylinder and a roller bearing crank member carried by said auxiliary piston and selectively latachable to said stationary support rod or said cylinder.

5. The interrupter of claim 1 wherein said auxiliary piston has a seal ring extending around the outer periphery thereof and in contact with the interior wall of said cylinder; said cylinder normally exerting a force on said auxiliary piston through said seal ring, which tends to move said auxiliary piston in the direction of movement of said cylinder.

6. The interrupter of claim 5 wherein said auxiliary and main pistons have one-way valves therein to permit gas flow into said main and auxiliary volumes.

7. The interrupter of claim 6 wherein said connection means includes a slide member connected to said cylinder and a roller bearing crank member carried by said auxiliary piston and selectively latchable to said stationary support rod or said cylinder.

* * * * *